US005143242A

United States Patent [19]

Millasich

[11] Patent Number: 5,143,242

[45] Date of Patent: Sep. 1, 1992

[54] PAINT BUCKET WITH DISPOSABLE LINER

[76] Inventor: David S. Millasich, 400 18th Pl., Manhattan Beach, Calif. 90266

[21] Appl. No.: 691,086

[22] Filed: Apr. 25, 1991

[51] Int. Cl.[5] ..... B65D 25/16

[52] U.S. Cl. ..... 220/404; 220/745; 220/721; 220/DIG. 27; 141/65

[58] Field of Search ..... 220/403, 404, 85 B, 220/85 V, DIG. 27, 745, 720, 723, 721, 93, 626, 627, 636, 902; 141/65

[56] References Cited

U.S. PATENT DOCUMENTS

| | | | |
|---|---|---|---|
| 2,378,517 | 6/1945 | Trautman | 220/85 B |
| 2,678,764 | 5/1954 | Carlson | 220/404 |
| 2,861,714 | 11/1958 | Glossop | 220/85 B |
| 2,932,321 | 4/1960 | Mercier | 220/85 B |
| 3,173,573 | 3/1965 | Donegan | 220/93 |
| 3,545,644 | 12/1970 | Toyama et al. | 220/404 |
| 3,752,494 | 8/1973 | Dunn | 220/404 |
| 3,773,211 | 11/1973 | Bridgman | 220/404 |
| 3,815,778 | 6/1974 | Martin | 220/404 |
| 4,136,802 | 1/1979 | Mascia et al. | 220/723 |
| 4,294,379 | 10/1981 | Bard | 220/404 |
| 4,615,455 | 10/1986 | Tansill | 220/85 B |
| 4,821,896 | 4/1989 | Cheng | 220/404 |
| 4,974,393 | 12/1990 | Rich et al. | 141/65 |

FOREIGN PATENT DOCUMENTS

| | | | |
|---|---|---|---|
| 613732 | 12/1960 | Italy | 220/85 B |

*Primary Examiner*—Stephen Marcus
*Assistant Examiner*—S. Castellano
*Attorney, Agent, or Firm*—Frank J. Dykas; Craig M. Korfanta; Ken J. Pedersen

[57] ABSTRACT

Disclosed is a paint bucket (11) lined with a disposable plastic bag type liner (15). Combination bucket and liner (10) includes an air evacuation or extraction provision to "suck" liner (15) firmly against the interior of bucket (11). The individual liners (15) are initially held in bucket (11) using an airtight circumferential sealing ring (16) which engages rim (14) of bucket (11). Most of the air which is trapped between liner (15) and the interior surface of bucket (11) is then evacuated out a closable orifice (17) in the lower portion of bucket (11).

2 Claims, 3 Drawing Sheets

PAINT BUCKET WITH DISPOSABLE LINER

DESCRIPTION

Background of the Invention

1. Technical Field.

This invention generally relates to containers for storing and applying paint. More particularly, this invention relates to a painter's bucket which utilizes disposable plastic liners to eradicate the need to wash the bucket after use.

2. Background Art.

A long standing problem among professional and do-it-yourself painters has been the necessity of cleaning the various tools and containers, i.e. brushes, rollers, pans and buckets, after a days painting.

Because of their relative depth, buckets are particularly difficult to clean. This problem is exacerbated by dried paint around the upper edges of the bucket where the painter has wiped excess paint from the brush. Inevitably, several layers of paint accumulate around the upper edge of the bucket, eventually necessitating discarding the entire bucket.

LEWIS, JR., U.S. Pat. No. 4,298,134 teaches a related invention which uses a flexible plastic film bag in combination with a standard metal paint can and a specially constructed plastic lid to enable the metallic can to be re-used. One of the primary problems with using metal paint cans to paint from is that they are significantly heavier that their plastic counter parts. Metal cans typically come in one and five gallon sizes. Professional painters oftentimes prefer a two gallon container since this represents an ideal compromise between weight and quantity of paint which can be comfortably carried.

An additional and at least as significant of a problem is the difficulty of filling a plastic bag with paint inside of a metal can. If the bag is folded over and around the top of the can, air is trapped between the bag and the can. As the paint is poured into the bag, the air is displaced and will escape out, usually causing the bag to disengage from the can and fall in on itself. This is identical to the more common experience of dumping grass clippings into a bag inside of a garbage can. In the case of the paint can, if the bag is sealed tightly around the edge to prevent the bag from disengaging the can, a significant amount of space is wasted by "inflated" side walls. Additionally, since the plastic liner is free to move around inside of the can, it is virtually impossible to pour from a plastic lined can. Column 3, lines 59–63 of the LEWIS disclosure specifically addresses this shortcoming.

The forgoing problems prompted a another prior solution which is disclosed in AHERN, U.S. Pat. No. 4,112,973. AHERN teaches the use of a semi-rigid thermoplastic vacuum formed liner which includes ducts to allow the air which would otherwise be trapped to escape as the liner is inserted into the can or bucket. The only problem is that the liners are much more expensive to manufacture and have not found widespread acceptance.

What is needed is a paint bucket which incorporates the advantages of the flexible plastic bag liners and the advantage of stability of the semi-rigid thermoplastic liner without the associated high cost.

It is therefore an object of the instant invention to provide a disposable liner paint bucket system which exhibits most or all of the advantages of the prior art and at the same time to limit or all together eliminate the disadvantages of the prior art.

DISCLOSURE OF INVENTION

These and other objects are accomplished using a paint bucket lined with a disposable plastic bag type liner and which includes an air evacuation or extraction means to "suck" the liner firmly against the interior of the bucket. The individual liners are initially held in the bucket using an airtight circumferential sealing ring which engages the rim of the bucket. Most of the air which is trapped between the liner and the interior surface of the bucket is then evacuated out a closable orifice in the lower portion of the bucket.

Advantageously, a one way valve is used to facilitate removing the trapped air without allowing air from the environment to re-enter the void between the liner and the bucket. A mechanical air pump, such as a tire pump with an inverted seal, can be used to suck the air out, or it can be accomplished in the standard manner employing the human diaphragm since it is unnecessary to completely evacuate the space.

BEST MODE FOR CARRYING OUT INVENTION

Figure 1:
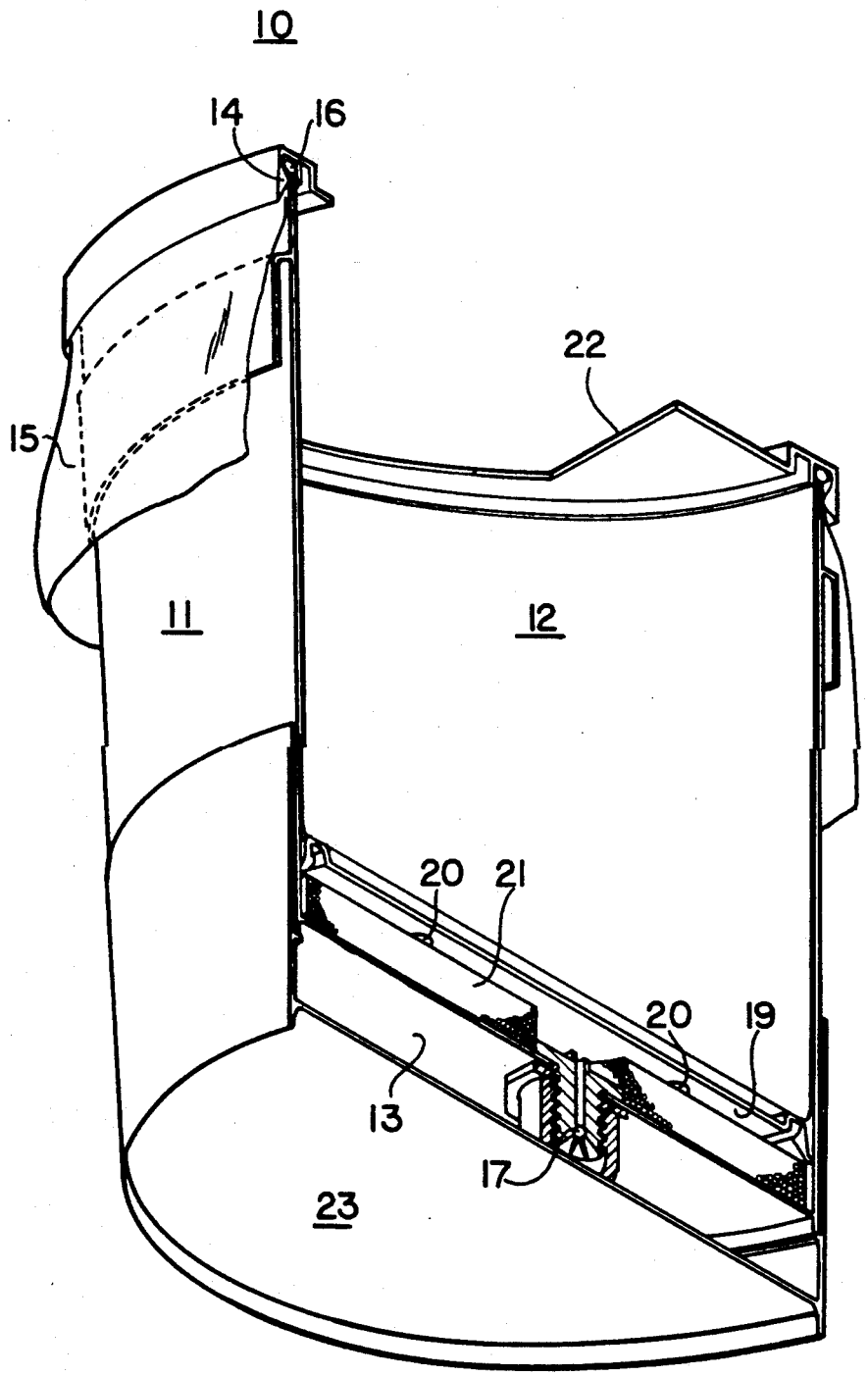
FIG. 1 is a three quarter partial section view of the painter's bucket and disposable liner.
Figure 2:
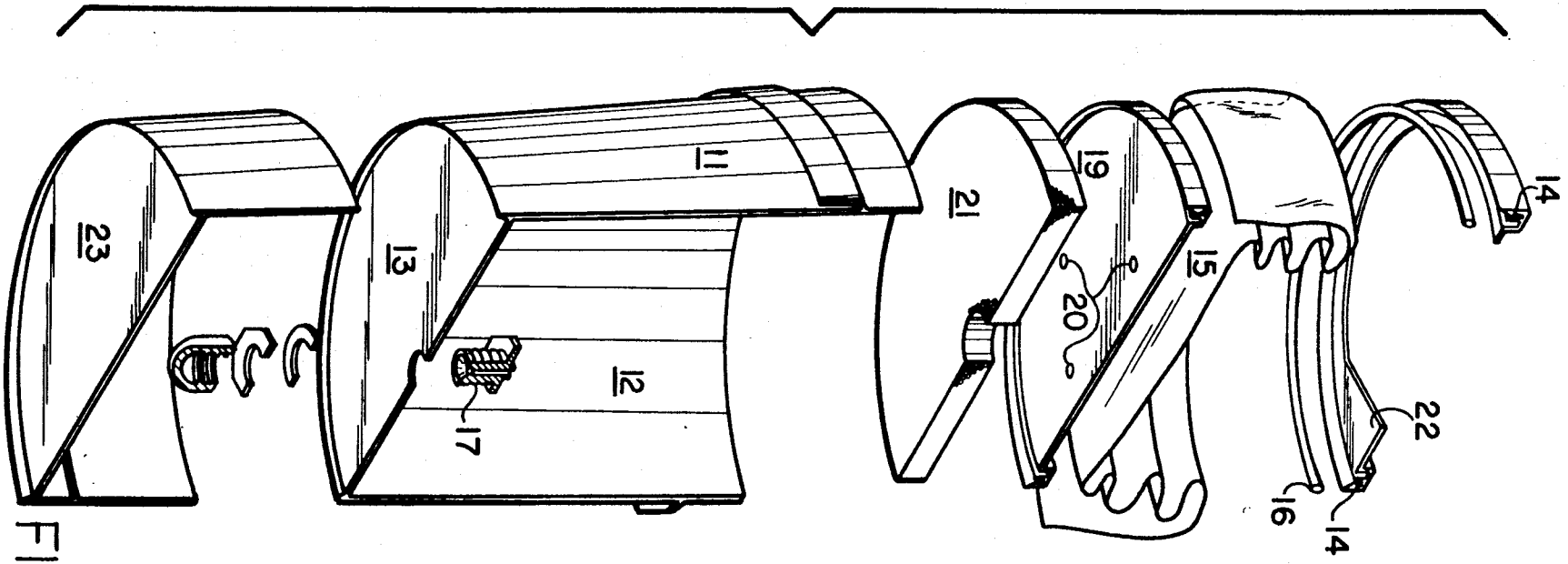
FIG. 2 is an exploded three quarter partial section view of the painter's bucket and disposable liner.
Figure 3:
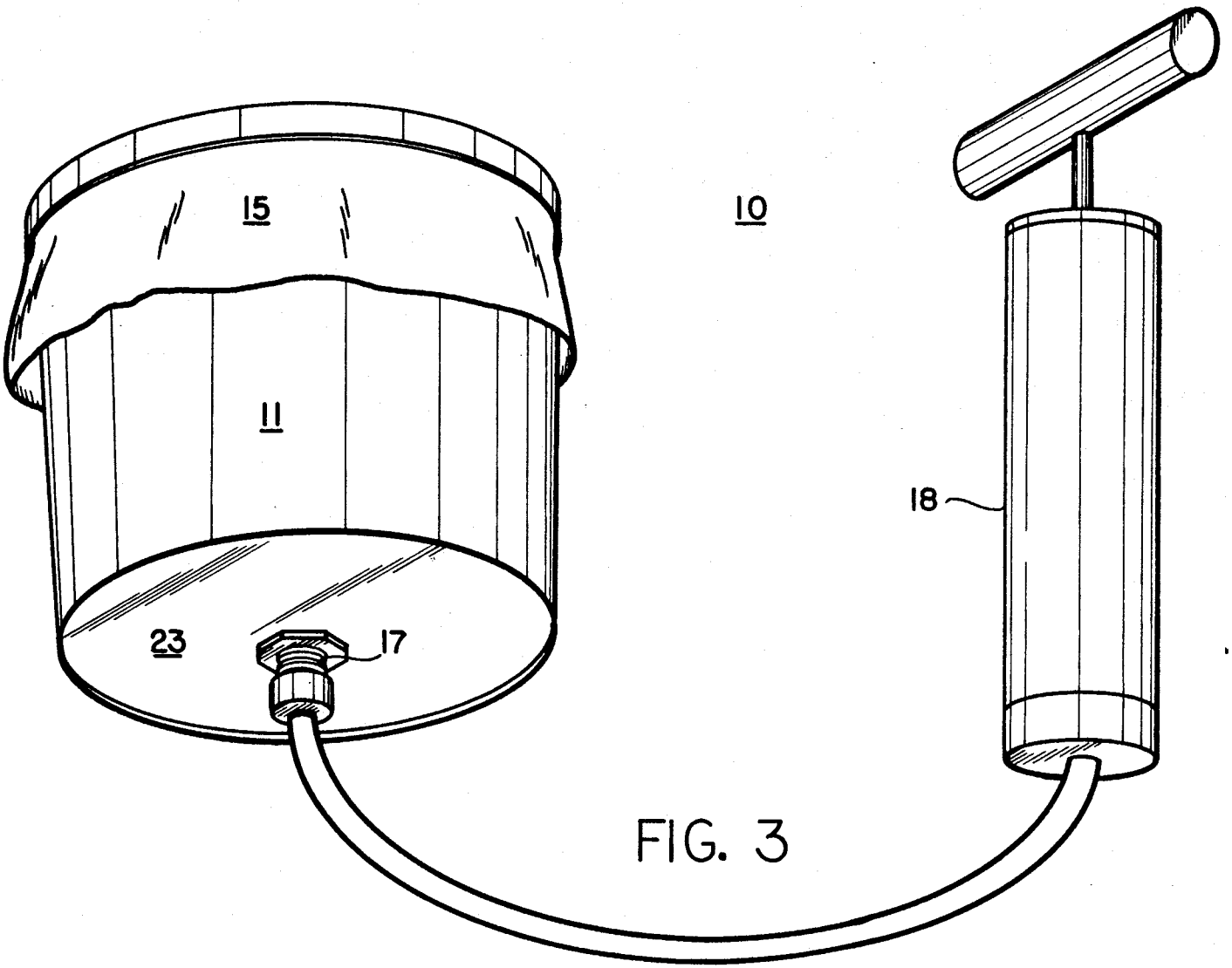
FIG. 3 is an assembled three quarter view of the painter's bucket and disposable liner.

Referring now to the drawings, a preferred embodiment of the disposable liner-painter's bucket 10 is illustrated in detail. Disposable liner-painter's bucket 10 incorporates modified light weight plastic painter's bucket 11 and flexible plastic bag liners 15. Paint bucket 11 generally has a conical section forming side walls 12 being attached to a disk shaped bottom wall 13 to form a container or paint reservoir. A sealing lip 14 extends radially around the upper perimeter rim of bucket 11 to provide a means for engaging a lid to form an air and watertight seal.

A sealing ring 16 is provided to engage sealing lip 14 over liner 15 to thereby form an airtight seal between liner 15 and the interior of bucket 11. Here, a disk surface segment 22 is attached along an arc of sealing ring 16 to form a straight edge across the bucket opening which a painter can use to wipe excess paint from his or her brush.

A one way air valve 17 is here attached through bottom wall 13 approximately at its center. The valve is of well known configuration and allows air to pass only from the interior reservoir to the environment outside of the bucket. It should be noted that many other selectably closeable orifices could be employed to accomplish the desired result.

A base plate 19 is suspended in spaced relation to air valve 17. Base plate 19 prevents liner 15 from being sucked into air valve 17 and provides support for the weight of the paint within the reservoir. A plurality of air holes 20 are formed in base plate 19, as well as around its marginal edges, to encourage liner 15 to occupy the entire space available within the reservoir. Here, base plate 19 is suspended on top of an open celled foam rubber cushion 21. It should be noted however, that base plate 19 could be suspended by virtually any open celled or air permeable means, including fixed pillars, columns, struts or other support members. The base plate support means simply must allow air to escape from the space between liner 15 and bucket 11, out through valve 17.

Because one way air valve 17 protrudes out from bottom wall 13, a conical-segment bucket stand 23 is provided and is frictionally engaged with the bottom extremity of bucket 11. Bucket stand 23 performs several functions including the provision of a storage compartment for extra liners, tools and the like, and makes disposable liner-painter's buckets 10 stackable for convenient storage and merchandising. However, it should be understood that other embodiments are contemplated which include an inset air valve, a surface mount air valve or an expandable volume space between the liner and the bucket, all of which will render the bucket stand unnecessary.

In use, the painter simply fits a plastic liner 15 in bucket 11, pulling the upper edge of the liner around, down and over sealing lip 14. Sealing ring 16 is then installed over liner 15 and engaged with sealing lip 14 to form an airtight seal between liner 15 and bucket 11. An air pump 18 is then attached to the exterior portion of valve 17 and activated to extract air from the space between liner 15 and bucket 11. The air pump is then removed and the bucket is ready for use. When the painter is finished using the bucket for the time being, he or she empties any remaining paint from the reservoir, removes sealing ring 16 and withdraws liner 15 from bucket 11. By removing ring 16, the airtight seal can easily be broken so that liner 15 will separate from the interior side walls 12 and base plate 19. The fact that liner 15 adheres to side walls 12 and base plate 19 when the airtight seal is in place and the air is withdrawn from bucket 11, allows paint to be easily poured from bucket 11 without disturbing liner 15.

While there is shown and described the present preferred embodiment of the invention, it is to be distinctly understood that this invention is not limited thereto but may be variously embodied to practice within the scope of the following claims.

I claim:

1. A painter's bucket which comprises:

a container having an inner reservoir and an upper perimeter rim;

a flexible liner being positioned within the reservoir and in contact with the upper perimeter rim;

sealing means forming an airtight seal between the liner and the container;

air extraction means for extracting air from between the container and the liner;

a suspended bottom being positioned within the reservoir for supporting the liner in spaced relation to the air extraction means, said suspended bottom comprising:

an open-celled base plate support member being positioned within the reservoir between the liner and the container; and a base plate being positioned between the base plate support member and the liner.

2. A painter's bucket which comprises:

a container having an inner reservoir and an upper perimeter rim;

a flexible liner being positioned within the reservoir and in contact with the upper perimeter rim;

sealing means forming an airtight seal between the liner and the container;

air extraction means for extracting air from between the container and the liner;

a suspended bottom being positioned within the reservoir for supporting the liner in spaced relation to the air extraction means, said suspended bottom comprising:

an open-celled base plate support member being positioned within the reservoir between the liner and the container; and a base plate being positioned between the base plate support member and the liner, said base plate having a plurality of air holes therethrough to facilitate the extraction of air from between the liner and the container.

* * * * *